United States Patent [19]

Zivley

[11] Patent Number: 5,062,532

[45] Date of Patent: Nov. 5, 1991

[54] SORTING MACHINE INCLUDING PHOTO SITE PROCESSING

[75] Inventor: George A. Zivley, Houston, Tex.

[73] Assignee: ESM International, Inc., Houston, Tex.

[21] Appl. No.: 519,886

[22] Filed: May 7, 1990

[51] Int. Cl.[5] ..... B07C 5/342

[52] U.S. Cl. ..... 209/581; 209/586; 209/587

[58] Field of Search ..... 209/576, 577, 580, 581, 209/586, 587, 639

[56] References Cited

U.S. PATENT DOCUMENTS

| | | | |
|---|---|---|---|
| 3,899,415 | 8/1975 | Codding et al. | 209/581 |
| 4,147,619 | 4/1979 | Wassmer et al. | 209/580 X |
| 4,239,118 | 12/1980 | Lockett | 209/582 X |
| 4,246,098 | 1/1981 | Conway et al. | 209/912 X |
| 4,260,062 | 4/1981 | Lockett | 209/587 X |
| 4,513,868 | 4/1985 | Culling et al. | 209/581 |
| 4,626,677 | 12/1986 | Browne | 250/214 A |
| 4,647,211 | 3/1987 | Browne | 356/447 |
| 4,697,709 | 10/1987 | Codding | 209/549 |
| 4,774,718 | 9/1988 | Zivley et al. | 377/2 |
| 4,784,275 | 11/1988 | Fridge | 209/580 X |

*Primary Examiner*—Michael S. Huppert
*Assistant Examiner*—Edward M. Wacyra
*Attorney, Agent, or Firm*—Vaden, Eickenroht, Thompson & Boulware

[57] ABSTRACT

A sorting machine is disclosed in which the viewing window is electro-optically observed using an array of photodetectors, each observing a photo site or pixel of the viewing window. Such detection allows for normalizing by photo site viewing to individually account for background and photodetector sensitivity differences from photo site to photo site. Such detection also provides for detecting a series of defects existing for each photo side and, thus, rejecting products that have a larger than acceptable number of successively detected defective photo sites. Also disclosed is a circuit for rejecting a defective product based on sensing where its trailing edge is or should be if covered up by a successive overlapping product. Such detection also allows for rejecting products that are either too long or too short. All of this is done by digital processing resulting from the digitizing permitted by photo site detection.

5 Claims, 4 Drawing Sheets

SORTING MACHINE INCLUDING PHOTO SITE PROCESSING

BACKGROUND OF THE INVENTION

1. Field of the Invention

This invention pertains to sorting machines used to sort fungible products, such as nuts and many other agricultural products, by passing the products along a channel having a viewing window and detecting products that are substandard in shade from those that are within standard limits and rejecting those that are substandard.

2. Description of the Prior Art

A typical sorter of fungible products of the type just described is comprised of one or more channels that are gravity fed from a top loaded hopper, the products flowing in the channel in a fairly constant stream and sometimes overlapping one another. The channel background is electro-optically observed through a viewing window while no products are flowing by at least one photodetector to produce an output that is representative of that background. Although only one photodetector is used in a very simple machine, it is common to employ multiple photodetectors, for example, three, viewing the product flow from various different viewing angles. The background for each photodetector is separately determined for such machines. This process of determining a signal representative of the background without product flow is know as "normalizing".

When the product flow is initiated and the actua product flow is electro-optically sensed, the background signal is subtracted from the total output so that the background is discounted in determining whether the product flow includes all standard or acceptable products or includes a substandard product now and again. Assuming the latter, when a substandard product is sensed by an electro-optical photodetector by having at least a portion of its surface area being either lighter or darker than a standard shade, then a reject signal is produced, following a suitable delay, to activate a reject mechanism, which diverts the substandard product from the channel. The delay is necessary for the product to fall below the viewing window and be opposite the reject mechanism. The reject mechanism is typically a burst or jet of air that blows the substandard product out of the ordinary channel flow to drop into a reject bin.

From time to time, product flow must be suspended for the viewing window to be either blown clean or wiped clean of dust and to again determine a new "normalizing" value for the background shade.

Although such prior art sorting machines as generally described above have used digital logic in switching from sort mode to normalizing mode and for determining the timing delay for the proper operation of the reject mechanism to expel a substandard product, the analog value of the observed shade of the product flow as a whole in the viewing window has determined the activation of the reject mechanism. In many cases, however, discrimination of substandard products in various ways is not possible with such prior art sorting machines.

For example, it is known that the background of the entire viewing window is not of uniform shade. Should a marginally shaded product be on one side of the channel as it passes the viewing window, it might pass as acceptable, whereas should the same product be on the opposite side of the channel as it passes the viewing window, it might be rejected. This is because the overall light intensity for the two passes would be slightly different. When the "normalized" value for the background is respectively subtracted, then the results would be different from each other.

Another example is the desire on occasion to pass products with small surface substandard spots, but not with larger spots. For example, almonds used in candy bars are acceptable if their skins are only slightly scraped to leave a small spot. A large scrape leaving a large spot will result in that almond being classified as substandard for many purposes. A spot of white nut meat without skin is very white when compared to the dark brown skin of an almond. When the overall light intensity of an entire viewing window determines if an almond should be accepted or rejected, it is exceedingly hard to control the setting to discriminate on the basis of spot size. This is especially true when more than one almond may be in the viewing window at the same time, each with a small spot.

Another problem that has occurred in the prior art is the "missing" of a properly detected defective product by the expelling mechanism. That is, not only must a substandard product be accurately detected, the signal for activating the reject air blast must be delayed or timed so as to expel the substandard product from the product flow. Assuming that there is a detected substandard spot that would cause a product to be rejected and that spot is on the front end, many prior art machines might cause the reject air blast to miss the product by timing the activation pulse from the spot detection. Were the spot in the middle, the timing would properly time the reject mechanism. Spot detection at the rear of a product has also, in some cases in the prior art, resulted in timing misses.

Yet another example of products virtually impossible to sort by the prior art machines are products that are abnormally short or long. That is, in many cases, broken pieces are desirably discriminated against as being substandard by being abnormally short. Abnormally long pieces are sometimes also substandard for a particular purpose. Again, abnormally long almonds are not desirable for use in a candy bar.

When products are viewed singly by the prior art machines, they can be discriminated against since they would occupy an acceptable percentage of the overall viewing window or, alternatively, as being substandard by occupying an abnormally small or large percentage of the overall viewing window. However, when the product flow is fast, as it desirably is with the newer machines, mistakes on this basis of discrimination do occur because of product overlap. A broken piece may get by when included in the viewing window with at least part of another product. Perfectly acceptable products may be rejected when they appear together by being mistaken for an abnormally long product.

Therefore, it is a feature of the present invention to provide improved observing of the viewing window of a sorting machine for shades of gray by individually observing a plurality of photo sites therein and determining substandard rejection criteria based on a logic relationship of a plurality of photo site observations.

It is another feature of the present invention to provide improved observing of the viewing window of a sorting machine by photo site locations and normalizing each photo site for background shade and the sensitivities of the photodetectors observing the respective photo sites.

It is still another feature of the present invention to provide improved observing of the viewing window of a sorting machine by photo site locations and determining when a predetermined sequential number of such photo sites exist so that spot size discrimination sorting can be achieved.

It is yet another feature of the present invention to provide improved timing of the reject mechanism in a sorting machine by applying digital timing techniques to always activate the reject mechanism from the detection of the trailing edge of the product to be rejected and to cause such rejection even when the trailing edge might be actually nondetectable because of product overlap in the viewing window.

It is still another feature of the present invention to provide improved observing of the viewing window of a sorting machine by photo site locations and by leading and trailing edge detection and logic means to discriminate against both substandard short products and long products with respect to standard length products.

SUMMARY OF THE INVENTION

An electro-optical photodetector array of linear photodiodes are employed for viewing the viewing window of a sorting machine channel so as to effectively divide the viewing window into a succession of photo sites, sometimes also referred to as "pixels". Typically, such photo sites are about 0.01 inch high and 0.001 inch wide. A complete coverage of a typical viewing window is accomplished by 128 to 1024 photodiodes; however 256 of such photodiodes are employed in the preferred embodiment. The viewing window is normalized by scanning through the sequence or succession of photodiodes using a timing-and-control network utilizing a 2 megaHertz oscillator having a multiphase clock output. Each photodiode successively produces an electrical output during its sample period of time that is representative of the light intensity of the background that it views and the detection sensitivity of the photodiode. A difference amplifier compares the output to a stored output drawn from a memory device and produces a positive or negative output depending on the relationship of the two values. A subsequent normalizer comparator connected to ground or other circuit normal as an input develops a positive or negative signal to an up/down memory input device that reloads the memory device, position by position, corresponding to the respective photodiodes. After a first scan through the photodiodes, they are iteratively rescanned in similar fashion until the memory device accurately is normalized to the photo site backgrounds and photodetector sensitivities.

The sort machine then switches to sort operation and the product flow through the channel begins. The photodiodes are again scanned for determining defective values from the photodiodes with respect to their own respective photo site backgrounds and photodiode sensitivities. Of course, when a sorting mode scan is performed, the values in the memory device are not changed.

Although the operation could be set to reject a product having a single detected -photodiode defect, more commonly, a parallel loaded shift register is used to receive a defect signal and to serially advance such signal through the register with each successive defect signal until a reject signal from the shift register is produced. A photodiode signal that is not a defect signal resets the shift register. Thus, only a predetermined number of uninterrupted successive defect signals will produce a reject signal. This predetermined number can be established to correspond to the product spot size that is classified as being "substandard".

The circuit that assures proper timing of the reject mechanism includes separately detecting the leading and trailing edges of products in the viewing window with a photodetector. For a shorter than typical product, the reject mechanism is activated, after an appropriate delay, by the detected trailing edge whenever a product is classified as substandard for rejection purposes during the period the product is observed. A crowding of the products may, however, obscure the trailing edge of a product. Thus, a gated oscillator timer is also activated with the detection of the leading edge to produce an artificial "trailing edge" signal at a time following the detection of the leading edge for typical length products. If no actual trailing edge is detected for a product classified as a substandard reject by the time the artificial trailing edge signal of the gated oscillator occurs, this signal will cause the reject mechanism to activate, after the appropriate delay time.

The output of the gated oscillator can also be used, if desired, to initiate a network for discriminating against products on the basis of length alone. The detection of the leading edge of a product can initiate a monostable timer device having a period equal to the minimum length product. If the trailing edge of a product is detected while the monostable timer device is on, then the product is too short and a reject signal is produced.

The gated oscillator period is set for a typical product length. Therefore, if it is into a second period before the trailing edge of a product is detected, this can be used as an indication that the product being detected is abnormally long and should be rejected for that reason. The leading edge of the second period starts the monostable timer again, which is on when the actual trailing edge of the product occurs. Thus, a reject signal is produced in the same manner as for the product that is too short.

Also provided is a means for reversing the rejection mechanism to activate on the detection of acceptable products and pass substandard products. This is done, for example, for recovering good products from heavily contaminated products. This is done by enabling the reject mechanism with the detection of the leading edge of a product and canceling the enablement with the receipt of a reject signal from the classification circuitry. This "reverse fire" capability is provided by a switch selectable by the operator.

BRIEF DESCRIPTION OF THE DRAWINGS

So that the manner in which the above recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the drawings illustrate only preferred embodiments of the invention and is therefore not to be considered limiting of its scope as the invention may admit to other equally effective embodiments.

In the drawings

DESCRIPTION OF THE PREFERRED EMBODIMENTS

Figure 1:
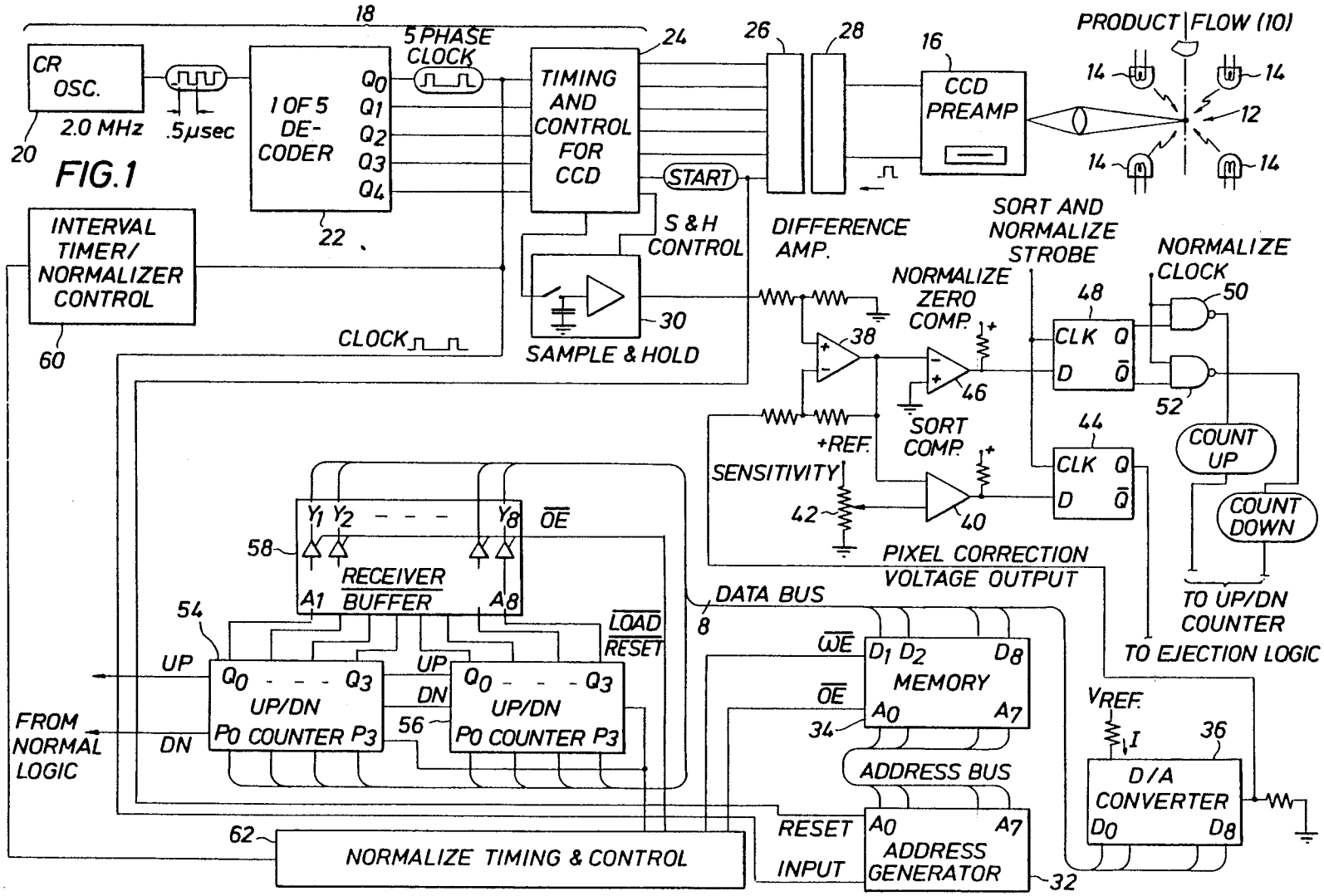
FIG. 1 is a block diagram of a portion of a sorting machine circuit utilizing photo site detection for normalizing and sorting operation with respect to normalizing in accordance with a preferred embodiment of the present invention.

Now referring to the drawings and first to FIG. 1, a partial operating block diagram is shown in accordance with a preferred embodiment of the present invention. A channel of product flow 10 is shown passing through a frame or a viewing window area 12 brightly illuminated by a system of lights 14. Although four lights are shown, a greater or lesser number can be employed. The main purpose of the lighting system is to cause the products to exhibit a bright light intensity and to eliminate any shadows as much as possible. A photodetector 16 in the form of a photodiode or a charge coupled diode, a related optical system and a CCD preamplifier is shown focused on a photo site in the viewing window. Each photo site or pixel is one measurement unit high for the photodiode being used, typically on the order of 0.01 inch, and one unit wide, typically on the order of 0.001 inch. An acceptable photodiode array is one of the K Series of wide aperture linear arrays (RL1024K, RL0512K, RL0256K, and RL0128K) made by EG&G Reticon. The RL0256K array of 256 photodiodes has been successfully employed. Each of the photodiodes in the array develops an equivalent analog electrical output signal proportional to the viewed light intensity during the period of time each successive diode is activated. The entire viewing window is viewed by the succession of activations of the photodiodes in the array.

A timing-and-control network 18 includes a high frequency oscillator 20, which preferably operates at 2.0 megaHertz. For convenience, a clock phaser 22 develops a series of phased clock pulses, as shown on the first five lines of FIG. 2, for providing the clock operation of CCD controller network 24 and for other clocking purposes. The control outputs to the photodetectors and the developed signals therefrom are supplied via suitable connectors 26 and 28. Only one photodetector is shown for convenience, but the others are similarly operated.

When the time is appropriate to activate photodetector 16, a suitable start or activate signal is produced, which results in an electrical output proportional to the photodetector response during the sampling time period at an appropriate time, the signal progressing through controller network 24 to a sample-and-hold device 30.

A coordinated clock pulse also activates address generator 32, which, in turn, selects from the position of memory device 34 the stored normalized value stored therein associated with photodetector !6. This value is applied, following digital-to-analog conversion in D-to-A converter 36, to difference amplifier 38 simultaneously with the application of the stored photodetector signal from sample-and-hold device 30. The difference value, which can be either positive or negative depending on whether the photodetector signal is larger or smaller than the stored normalized value, is applied to sort comparator 40, which has a preset sensitivity input level or reference 42 applied thereto. If the applied difference value from difference amplifier 38 is larger than the sensitivity level set, then a defect output pulse is produced from D flip-flop 44 connected to the output of the sort comparator. The ejection logic (not shown in FIG. 1) receives the defect output and produces an ejection signal when a related number of these defect outputs occur in a manner hereafter explained. After the normalize value has been used, the value is returned to the appropriate position in memory device 34 until the same corresponding viewing photodiode is again activated during the next iterative scanning of the photodetectors. The remaining photodetectors are sequentially activated in like manner to develop defect outputs when each respective detected photodetector signal exceeds by a predetermined difference the respective associated normalized value drawn from memory device 34.

Periodically, for example, every twenty minutes, the sorting machine switches from the sorting mode just described to the normalizing mode.

In the normalizing mode, product flow is suspended and the photodetectors view only the background of the channel through the viewing window. Operation is the same as for the sorting mode, except sort comparator 40 is disenabled and normalizer zero comparator 46 is enabled and the memory devices are allowed to be updated. The coxparison input for comparator 46 is ground or circuit normal (zero) so that the output therefrom, which is the difference from the difference amplifier, produces either a positive or negative output to D flip-flop 48. A positive (or alternatively, a negative) output produces for each clock count through a buffer amplifier 50 a digital "count up" signal and a negative (or alternatively, a positive) output produces for each clock count through a buffer amplifier 52 a digital "count down" signal. The logic signals from buffer amplifiers 50 and 52 are provided to up/down counters 54 and 56, which, through receiver buffer network 58 cause each affected memory position value to be incrementally raised or lowered prior to restorage in memory 34.

Timing-and-control network !8 operates in the normalizing mode for about two seconds as determined by controllers 60 and 62, which allow the iterative enablements of the photodetectors and the memory position value adjustments to take place as above described until the values stored corresponding to each photodetector is a normalized product value determined by the light intensity of its respective photo site as detected by its respective photodetector. Each photodetector is typically only within about 10% in sensitivity to a nominal standard value. The normalized value stored is therefore a product of each of the absolute values of light intensity of the photo site background and the sensitivity of the photodetector that operates at that photo site. Since the same photodetector is employed at each photo site for sorting purposes, the individual normalization is appropriate to remove the background and photodetector variations from the absolute values of light intensities that relate solely to the product flow in the viewing window at the respective photo sites.

Figure 2:
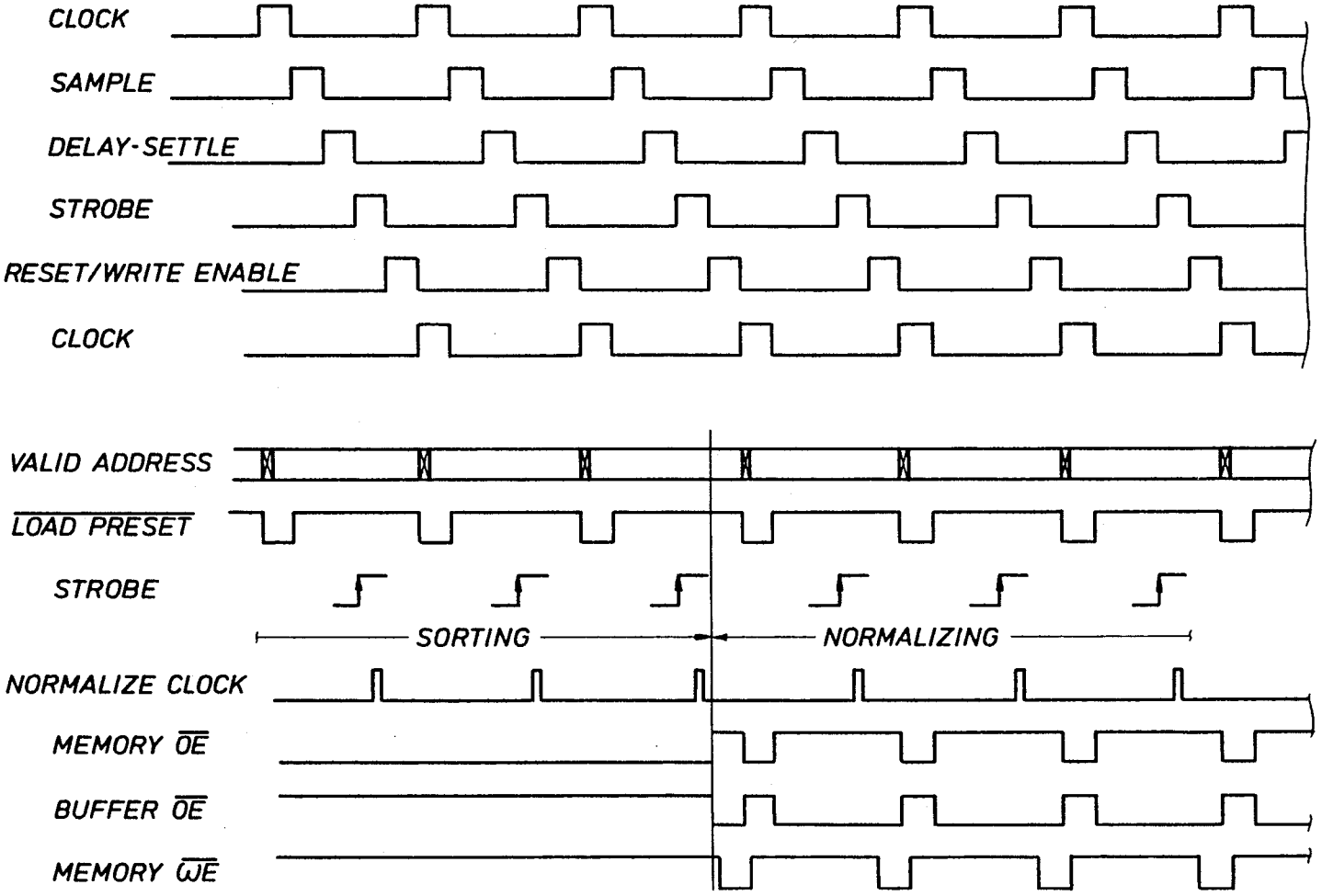
FIG. 2 is a timing diagram of the operation of the circuit shown in FIG. 1 in both its normal sorting operation mode and in its normalizing mode.

FIG. 2 shows the waveform operation including the possibility of writing into the memory network at appropriate times when the circuit is operating in the normalizing mode.

Figure 3:
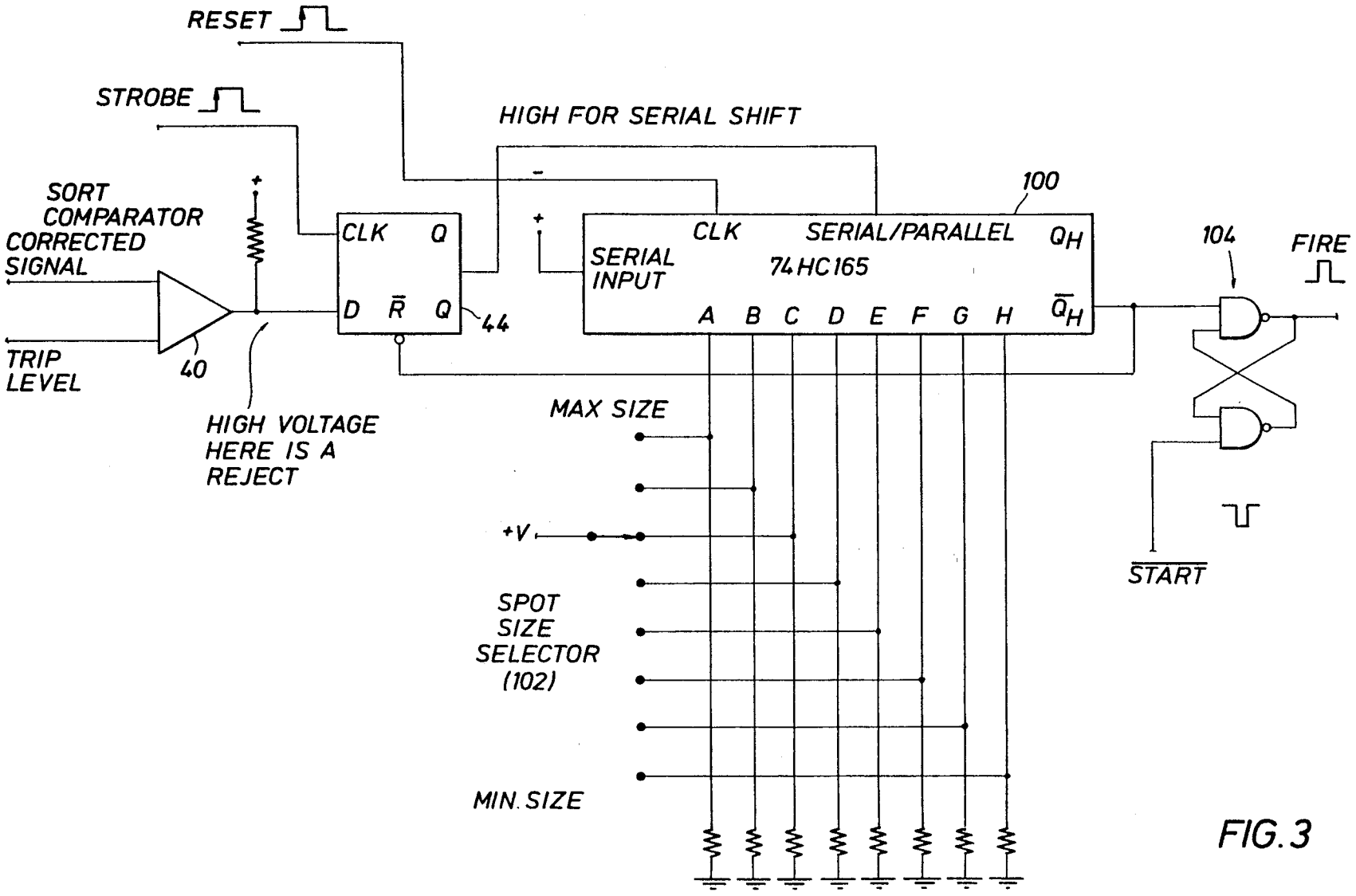
FIG. 3 is a block diagram of a portion of a sorting machine operating to classify as a rejection defect a spot of a predetermined size.

Now referring to FIG. 3, a block diagram of a circuit is shown suitable for classifying a defect of a predetermined size as sufficiently large for rejection purposes. The circuit is connectable to the circuit of FIG. 1 as may be seen by sort comparator 40 and D flip-flop 44 appearing in both illustrations. The key element of this "sizer" is a shift register 100 capable of two modes of operation, namely (1) parallel load and (2) serial load and serial shift. The size of the defect predetermined to cause reject is determined by a size control selector switch 102, which is arbitrarily for illustrative purposes set up for position C of the timer. Position C means that six consecutive individual photodetectors would have to indicate defect for the product to be rejected. Again, for the example where each photo site is 0.001 long, a total length of defect of 0.006 would be required to activate the reject mechanism. From the drawing, it will be seen for the exemplary register, which can be type number 74HC165, , sizing can be from a one photo site long spot (when switch 100 is connected to input H, to an eight photo sites long spot (when switch 100 is connected to input A). Obviously other registers with a different number of input positions can be employed, if desired.

Upon the encountering of a defect, a latch output is produced from D flip-flop 44 to set the mode of operation of the shift register, serial input and serial shift. The input that a defect has been detected is also put into the selected position, or position C for the illustrated example. If successive photo sites or pixels are also scored as defects, the single bit will be continually shifted toward the serial output stage. Should a single pixel arrive that is not, scored as a defect, the latch action of D flip-flop-44 will be reset and the register will revert to parallel load mode, the bit in the register being erased.

When a string of pixels scored as defects exceeds the number determined by the spot size selection requirement, the selected bit will reach the serial output stage and will trigger a reject pulse from network 104. The initiation of a reject pulse also resets latch 44 and register 100 in anticipation of the next cycle of operation.

Figure 4:
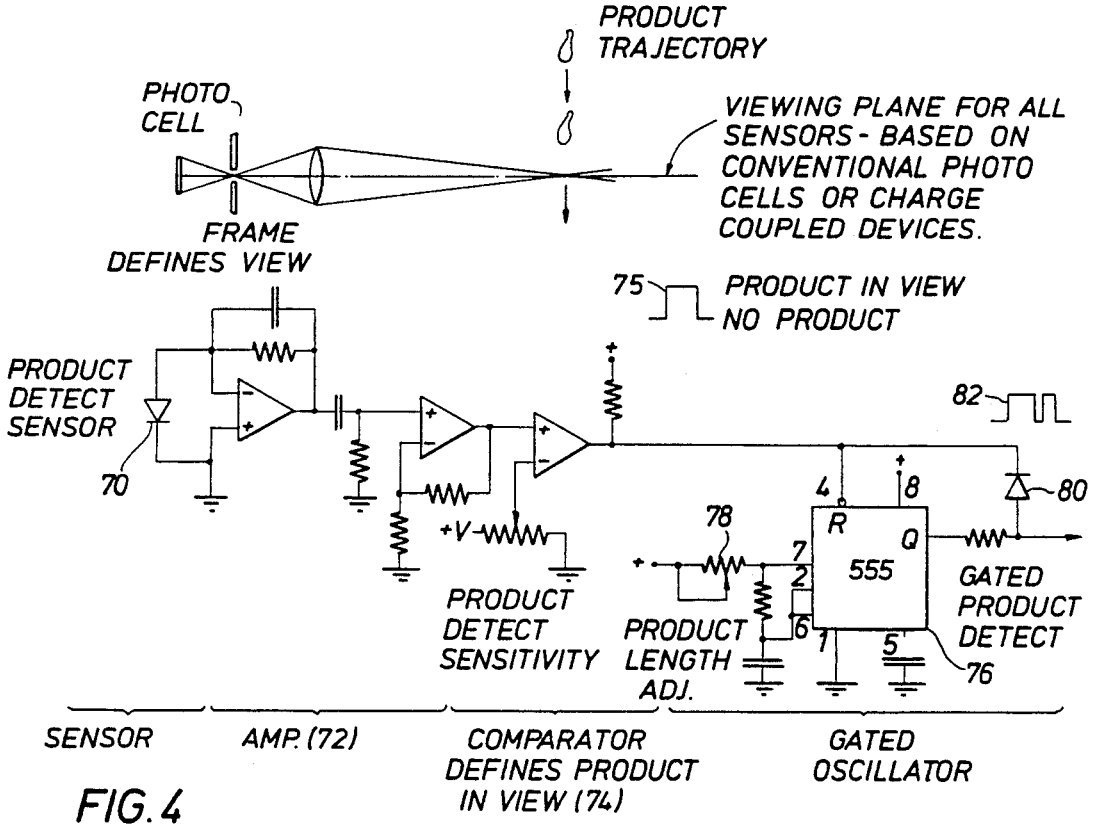
FIG. 4 is a block diagram of a portion of a sorting machine in an operating mode for developing a gated product detect signal relating to assuring that the reject signal occurs at a proper time to reject products classified as substandard.

Now referring to FIG. 4, a suitable circuit is shown for developing a logic output signal related to determining the accurate occurrence of reject signalling when products are classified as defective to actually expel the product from the product flow. A brightly illuminated viewing window is observed, as previously described, by a photodetector trained to view the viewing window. The photodetector or CCD device develops through a sensor 70, a high gain amplifier 72 and a comparator 74 an output that is a signal that shows either the presence or the absence of signal in the viewing window. The leading edge thereof coincides with the detection of the leading edge of a product within the viewing window and the trailing edge coincides with the detection of the rear or trailing edge of the product within the viewing window. Thus, for the waveform or product detect signal 75 shown, while the product is in the viewing window, the signal is positive and while there is no product within the viewing window, the signal is negative.

A timer device, preferably a type 555 gated oscillator 76, has a product length adjustment input in the form of an adjustable resistor 78. The setting of this resistor determines the length of a full period output for a "typical" length product. Timer 76 receives the positive-going leading edge detection signal, which is the output of comparator 74, and produces as its output a series of predetermined length pulses or periods of positive signals. A pause follows each timer pulse such that the pulse length plus the pause length can be used as the maximum length of an acceptable product, as explained below.

The output of timer 76 and the product detect signal are gated to a single output by diode 80. For a long product or crowded products where the end of the first products overlaps with a second and is not detectable, the product detect signal is still positive after the first pulse of the timer plus a pause, so the timer generates a second pulse. Assuming that the product detect signal soon ends, then gate 80 will produce a waveform 82 such as shown on the right side of FIG. 4. This waveform is a full timer pulse, followed by a standard timed pause, followed by a short pulse. The leading edge of the second pulse is determined by the timer and the trailing edge is determined by the trailing edge of product signal 75.

Figure 5:
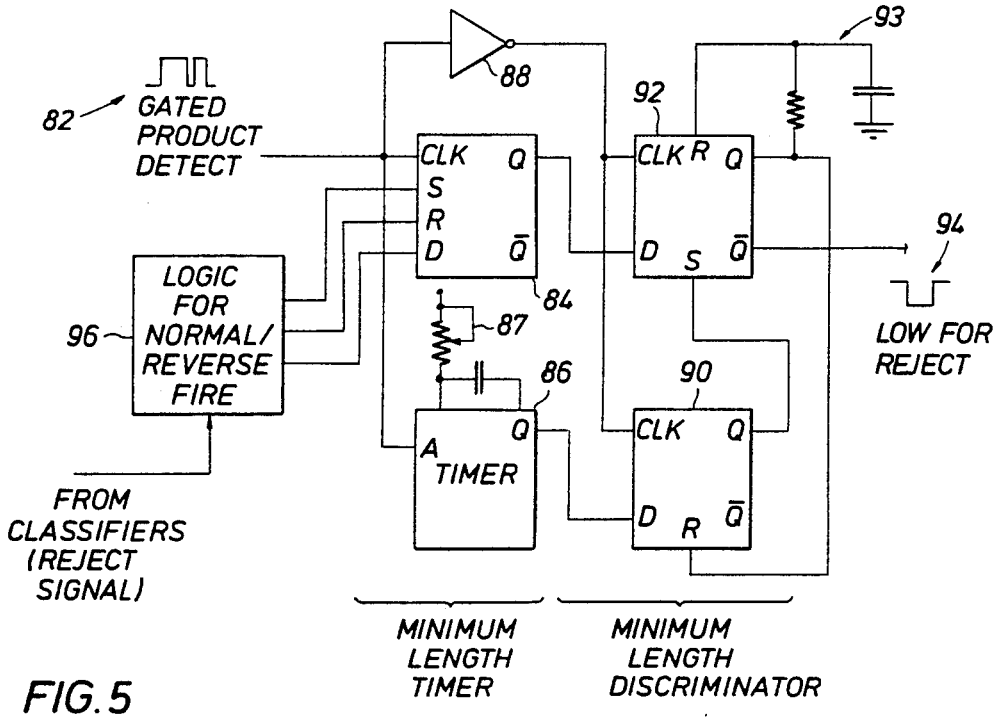
FIG. 5 is a block diagram of a portion of a sorting machine in an operating mode for rejecting unacceptable products that are either too short or too long.

Gated product detect signal 82 is used to activate a reject signal by the network shown in FIG. 5 when there is also a classified product to be rejected as indicated by circuit 96. When there is a trailing edge of a waveform period, there is a negative-going waveform edge. This negative-going edge is converted to a positive-going edge by invertor 88, which clocks on D flip-flop 92 to produce a low reject signal 94 after a suitable delay, as established by components 93. When there is a short cycle indicative of a short product, the triggering of the reject signal is with respect to the actual product length. If there is a typical product, the gated oscillator timer trailing edge and the product signal trailing edge will coincide in waveform 82 and either will cause the resulting triggering of the rejection signal. By the time the second pulse (in this case short pulse) the rejection signal has already occurred.

In some instances, however, it is desirable to reject products that are only defective or substandard because of length. Such rejection is capable by the inclusion of monostable timer 86 and D flip-flop 90. The leading edge of waveform 82 activates on timer 86, which is set by a suitable variable resistor 87 to be on for the length of time equivalent to an observed minimum acceptable product. If the timer goes off while waveform 82 is still in its first full period, nothing happens. A short period of waveform 82 will result in producing an output from D flip-flop 92 by the operation of invertor 88 and the clocking of D flip-flop 90 before it receives a D input from timer 86.

If an excessively long product occurs that produces a short second period of waveform 82, the trailing edge of the second part of the waveform will occur while timer 86 is in its second period. This produces a rejection signal in the same fashion as for a short product. Finally, it is sometimes desirable, especially when there is largely substandard or contaminated products being sorted, to reverse the "fire" so that the normally passed products are rejected and the normally rejected products are passed. This is easily done by providing a simple operator switch for reversing the state of the signal from logic circuit 96. Thus, the leading edge of every product detected enables D flip-flop 84 and only those products that are not classified as rejects through 96 will cancel the reject signal from occurring, as described above.

While several operable embodiments have been described and illustrated, it will be understood that the invention is not limited thereto, since many modification may be made and will become apparent to those skilled in the art.

What is claimed is:

1. In a sorting machine having at least one channel through which fungible products to be sorted flow, are electro-optically observed in a viewing window, and cause a defect signal to occur when observed to be substandard, the improvement comprising separate photodetectors for observing a respective one of a plurality of photo sites of the viewing window and producing an electrical output proportional to the respective photo site light intensities, timing-and-control means for controllably separably enabling each of said photodetectors during a sample period of time, and processing means for individually processing the respective photo site electrical outputs to determine when a successive number of adjacent ones of them are outside of a predetermined acceptable standard to produce a reject output.

2. In a sorting machine having at least one channel through which fungible products to be sorted flow, are electro-optically observed in a viewing window, and cause a defect signal to occur when observed to be substandard in shade, a background and photodetector normalizing circuit operable when there is an absence of product flow, comprising 'separate photodetectors for observing a respective one of a plurality of photo sites of the viewing window and producing an electrical output proportional to a product of the light intensity of the photo site and the detection sensitivity of the photodetector for that photo site, timing-and-control means for controllably separably enabling each of said separate photodetectors for producing an electrical output during a sample period of time and subsequently controllably producing each of said sampled outputs, a difference amplifier for receiving each produced sampled output from said timing-and-control means and producing a positive or negative output depending on the relation of each sampled output to a compared respective associated stored value of a respective background valve associated with each respective photodetector simultaneously supplied o said difference amplifier, a normalizer comparator for producing a bi-logic output depending on whether the output of said difference amplifier is positive or negative with respect to a circuit normal, count up/down memory input means driven by the bi-logic output of said normalizer comparator, memory means receiving the output of said up/down memory input means and adjusting for each respective memory position the corresponding value previously stored in said memory means, said timing-and-control means outputting the adjusted value from said memory position of said memory means to said difference amplifier upon subsequent enabling of the photodetectors respectively associated with said memory positions, and said timing-and-control means iterating the above sequence of steps until the adjusted value stored in said memory means for each of said memory positions indicates that said adjusted value is substantially representative of its respective associated window background photo site as sensed by its respective associated photodetector.

3. In a sorting machine having at least one channel through which fungible products to be sorted flow, each product being observed by an electro-optical means over the length of the product by observing sequential photo sites of the product, each site being classified as a defect site or as an approved site, products being rejected by reject means from the channel when determined to be substandard by having an excessive number of sequential defect sites, a defect size determiner, comprising comparator means receiving the sequential site outputs from the electro-optical means and producing a site reject output when a site output from the electro-optical means exceeds a predetermined level and a site approved output when a site output from the electro-optical means does not exceed the predetermined level, a register for producing a substandard product output indicative of a substandard product when a preselected number of positions in said register have been sequentially serially exceeded, said register being reset with the occurrence of each site approved output from said comparator means, said register advancing a position with the occurrence of each site reject output, and means for setting the preselected number of consecutive positions for said rejector to advance in order to produce a serial output indicative of a substandard product, said register substandard product output activating the reject means to reject the substandard product from the channel.

4. A sorting machine having at least one channel one channel through which fungible products to be sorted flow, each product being electro-optically observed in a viewing window that is divided into a plurality of photo sites separately observed by a respective separate photodetector, the output of each separate photodetector being normalized for its own detection sensitivity and the background intensity of its photo site prior to product flow, a product that is substandard in shade causing a defect signal to occur, comprising separate photodetectors for observing a respective one of a plurality of photo sites of the viewing window and producing an electrical output proportional to the light intensity of the photo site and the detection sensitivity of the photodetector for that photo site, timing-and-control means for controllably separably enabling each of said separate photodetectors for producing an electrical output during a sample period of time and subsequently controllably producing each of said sampled outputs, a difference amplifier for receiving each produced sampled output from said timing-and-control means and producing a positive or negative output depending on the relation of each sampled output to a compared respective associated value of a respective background value associated with each respective photodetector simultaneously supplied to said difference amplifier, and memory means connected to said difference amplifier for storing a normalized value of the product of the background and photodetector sensitivity respectively associated with each of said photodetectors in a separate memory position of said memory means, said timing-and-control means causing the normalized value of the respective memory positions to be supplied to said difference amplifier corresponding with the respective associated photo site sampled outputs, said output of said difference amplifier producing an output for each photo site that is the difference between the sampled output and the respective associated normalized value of the memory position for that photo site such that a difference therein beyond a predetermined value produces a defect signal for the product.

5. A sorting machine in accordance with claim 4, wherein, said timing-and-control means includes switching means periodically switching said sorting machine to a normalizing mode from a sorting mode to suspend product flow in the channel, and including, a normalizer comparator enabled by said switching means switching to the normalizing mode connected to said difference amplifier for producing a bi-logic output depending on whether the output of said difference amplifier for each respective background value associated with each respective photodetector is positive or negative with respect to a circuit normal, count up/down memory input means driven by the bi-logic output of said normalizer comparator, said memory means receiving the output of said up/-down memory input means and adjusting for each respective memory position the corresponding value previously stored in said memory means, said timing-and-control means outputing the adjusted value from said memory position of said memory means to said difference amplifier upon subsequent enabling of the photodetectors respectively associated with said memory position, and said timing-and-control means iterating the above sequence of steps until the adjusted value sorted in said memory means for each of said memory positions indicates that said adjusted value is substantially representative of its respective window background photo site as sensed by its respective associated photodetector.

* * * * *